US010262598B2

(12) United States Patent
Guo et al.

(10) Patent No.: US 10,262,598 B2
(45) Date of Patent: Apr. 16, 2019

(54) GRAYSCALE VOLTAGE CALIBRATION DEVICE, SYSTEM, METHOD AND DISPLAY DEVICE

(71) Applicants: BOE Technology Group Co., Ltd., Beijing (CN); Beijing BOE Optoelectronics Technology Co., Ltd., Beijing (CN)

(72) Inventors: Lei Guo, Beijing (CN); Yi Zheng, Beijing (CN); Zhengxin Zhang, Beijing (CN); Di Wang, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 94 days.

(21) Appl. No.: 15/519,890

(22) PCT Filed: Oct. 14, 2016

(86) PCT No.: PCT/CN2016/102066
§ 371 (c)(1),
(2) Date: Apr. 18, 2017

(87) PCT Pub. No.: WO2017/148156
PCT Pub. Date: Sep. 8, 2017

(65) Prior Publication Data

US 2018/0096657 A1 Apr. 5, 2018

(30) Foreign Application Priority Data

Mar. 4, 2016 (CN) ..... 2016 1 0125579

(51) Int. Cl.
*G09G 3/36* (2006.01)
*G09G 3/3291* (2016.01)
(Continued)

(52) U.S. Cl.
CPC ..... *G09G 3/3291* (2013.01); *G09G 3/006* (2013.01); *G09G 3/3208* (2013.01);
(Continued)

(58) Field of Classification Search
CPC ..... G09G 3/2077; G09G 3/3607; G09G 3/3283–3/3296; G09G 2310/27;
(Continued)

(56) References Cited

U.S. PATENT DOCUMENTS 6,008,786 A * 12/1999 Kimura ..... G09G 3/3607 345/597
9,135,853 B2 9/2015 Kim et al.
(Continued)

FOREIGN PATENT DOCUMENTS

CN 102097052 A 6/2011
CN 102270433 A 12/2011
(Continued)

OTHER PUBLICATIONS

International Search Report and Written Opinion for International Application No. PCT/CN2016/102066 dated Dec. 26, 2016.
(Continued)

*Primary Examiner* — Sanghyuk Park
(74) *Attorney, Agent, or Firm* — Calfee, Halter & Griswold LLP

(57) ABSTRACT

A grayscale voltage calibration device comprises: an adjusting circuit, configured to receive an actual grayscale voltage value of a grayscale output from a source driver IC, compare the actual grayscale voltage value with a theoretically determined voltage value of the grayscale, and adjust the actual grayscale voltage when the comparison result indicates that the actual grayscale voltage is not equal or close to the theoretically determined voltage value; and a verification circuit, configured to verify whether the adjusted grayscale
(Continued)

voltage value is equal or close to the theoretically determined voltage value, and feedback the adjusted grayscale voltage value as a target voltage value to be input to a display panel of the display device to the source driver IC if yes, otherwise, control the adjusting circuit to further adjust the adjusted grayscale voltage value.

20 Claims, 4 Drawing Sheets

(51) Int. Cl.

| | |
|---|---|
| ***G09G 3/3208*** | (2016.01) |
| ***G09G 3/3225*** | (2016.01) |
| ***G09G 3/00*** | (2006.01) |
| *G09G 3/3275* | (2016.01) |

(52) U.S. Cl.
CPC ..... *G09G 3/3225* (2013.01); *G09G 3/3275* (2013.01); *G09G 3/3685* (2013.01); *G09G 2310/027* (2013.01); *G09G 2310/0275* (2013.01); *G09G 2320/043* (2013.01); *G09G 2320/0693* (2013.01)

(58) Field of Classification Search
CPC ..... G09G 2310/0275; G09G 2320/0271–2320/0276; G09G 2320/066–2320/0673
See application file for complete search history.

(56) References Cited

U.S. PATENT DOCUMENTS

| | | | | |
|---|---|---|---|---|
| 2007/0132689 | A1* | 6/2007 | Li | G09G 3/006 345/89 |
| 2011/0141097 | A1 | 6/2011 | Lee et al. | |
| 2013/0033531 | A1* | 2/2013 | Kim | G09G 3/2003 345/691 |
| 2013/0241967 | A1* | 9/2013 | Nishimura | G09G 3/3648 345/690 |
| 2013/0271507 | A1 | 10/2013 | Kim et al. | |
| 2015/0235600 | A1* | 8/2015 | Inada | G09G 3/3607 345/691 |
| 2015/0364093 | A1 | 12/2015 | Kim et al. | |

FOREIGN PATENT DOCUMENTS

| | | | |
|---|---|---|---|
| CN | 103985370 | A | 8/2014 |
| CN | 105632396 | A | 6/2016 |
| KR | 20050104757 | A | 11/2005 |

OTHER PUBLICATIONS

First Office Action for Chinese Patent Application No. 201610125579.3 dated Nov. 27, 2017.

* cited by examiner

GRAYSCALE VOLTAGE CALIBRATION DEVICE, SYSTEM, METHOD AND DISPLAY DEVICE

CROSS REFERENCE

The present application is based upon International Application No. PCT/CN2016/102066, filed on Oct. 14, 2016, which is based upon and claims priority to Chinese Patent Application No. 201610125579.3, filed on Mar. 4, 2016, and the entire contents thereof are incorporated herein by reference.

TECHNICAL FIELD

The present disclosure relates to the field of display technology, and in particular, to a grayscale voltage calibration device, a system, a method and a display device.

BACKGROUND

A source driver integrated circuit (IC) is configured to provide a grayscale voltage to a display panel to drive the display panel to display an image. Under a severe environment such as high temperature, low temperature, unstable power supply, or the like, an actual grayscale voltage value output from the source driver IC may be different from a theoretically determined voltage value, resulting in distortion of the displayed image of the display panel.

It should be noted that, information disclosed in the above background portion is provided only for better understanding of the background of the present disclosure, and thus it may contain information that does not form the prior art known by those ordinary skilled in the art.

SUMMARY

Accordingly, the present disclosure provides a grayscale voltage calibration device, a system, a method and a display device.

One aspect of the present disclosure provides a grayscale voltage calibration device applicable in a display device, wherein the grayscale voltage calibration device comprises:

an adjusting circuit, configured to receive an actual grayscale voltage value of a grayscale output from a source driver integrated circuit (IC), to compare the actual grayscale voltage value with a theoretically determined voltage value of the grayscale to obtain a comparison result, and to adjust the actual grayscale voltage when the comparison result indicates that the actual grayscale voltage is not equal or close to the theoretically determined voltage value to obtain an adjusted grayscale voltage value; and a verification circuit connected to the adjusting circuit, configured to verify whether the adjusted grayscale voltage value is equal or close to the theoretically determined voltage value, and to feedback the adjusted grayscale voltage value as a target voltage value to be input to a display panel of the display device to the source driver IC in the case where the adjusted grayscale voltage value is equal or close to the theoretically determined voltage value, otherwise, to control the adjusting circuit to further adjust the adjusted grayscale voltage value.

One aspect of the present disclosure provides a system for calibrating grayscale voltage comprising at least one source driver integrated circuit (IC) and at least one grayscale voltage calibration device described as above.

One aspect of the present disclosure further provides a display device comprising the system for calibrating grayscale voltage described as above.

One aspect of the present disclosure further provides a method for calibrating grayscale voltage, comprising:

an adjusting step: receiving an actual grayscale voltage value of a grayscale output from a source driver integrated circuit (IC), comparing the actual grayscale voltage value with a theoretically determined voltage value of the grayscale to obtain a comparison result, and adjusting the actual grayscale voltage when the comparison result indicates that the actual grayscale voltage is not equal or close to the theoretically determined voltage value to obtain an adjusted grayscale voltage value; and a verification step: verifying whether the adjusted grayscale voltage value is equal or close to the theoretically determined voltage value, and feeding back the adjusted grayscale voltage value as a target voltage value to be input to a display panel of the display device to the source driver IC in the case where the adjusted grayscale voltage value is equal or close to the theoretically determined voltage value, otherwise, returning to the adjusting step to further adjust the adjusted grayscale voltage value.

It is to be understood that both the foregoing general description and the following detailed description are exemplary and explanatory only and are not restrictive of the invention, as claimed.

This section provides a summary of various implementations or examples of the technology described in the disclosure, and is not a comprehensive disclosure of the full scope or all features of the disclosed technology.

DETAILED DESCRIPTION

Hereinafter, particular implementations of the present disclosure will be described in further detail with reference to the drawings and embodiments thereof. The following embodiments are provided for illustrating the present disclosure, rather than limiting the scope of the present disclosure.

Figure 1:
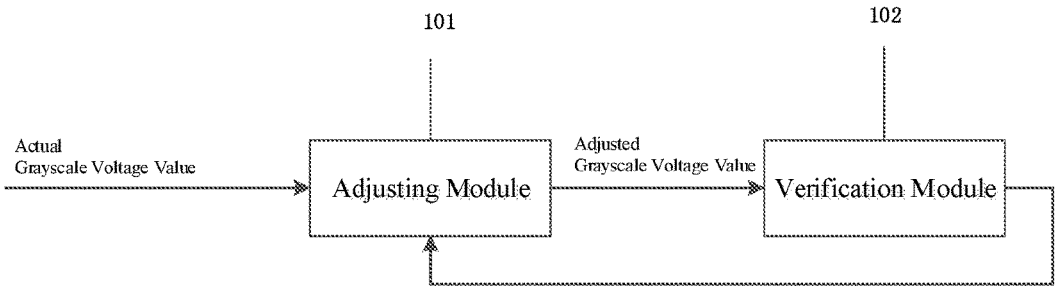
FIG. 1 is a structural schematic diagram of a grayscale voltage calibration device according to some embodiments of the present disclosure.

Referring to FIG. 1, the present disclosure provides a grayscale voltage calibration device applicable in a display device, wherein the grayscale voltage calibration device comprises an adjusting circuit 101 and a verification circuit 102.

The adjusting circuit 101 is configured to receive an actual grayscale voltage value of a grayscale output from a source driver integrated circuit (IC), to compare the actual grayscale voltage value with a theoretically determined voltage value of the grayscale to obtain a comparison result, and to adjust the actual grayscale voltage when the comparison result indicates that the actual grayscale voltage is not equal or close to the theoretically determined voltage value to obtain an adjusted grayscale voltage value.

The verification circuit 102 is connected to the adjusting circuit 101, and is configured to verify whether the adjusted grayscale voltage value is equal or close to the theoretically determined voltage value, and to feedback the adjusted grayscale voltage value as a target voltage value to be input to a display panel of the display device to the source driver IC in the case where the adjusted grayscale voltage value is equal or close to the theoretically determined voltage value, otherwise, to control the adjusting circuit 101 to further adjust the adjusted grayscale voltage value.

That is, the verification circuit 102 compares the grayscale voltage value adjusted by the adjusting circuit 101 with the theoretically determined voltage value, and the adjusting circuit 101 determines whether to further adjust the adjusted grayscale voltage value according to the comparison result.

In the embodiments of the present disclosure, the case in which the actual grayscale voltage value or the adjusted grayscale voltage value is not equal to the theoretically determined voltage value may comprise: the actual grayscale voltage value or the adjusted grayscale voltage value being higher than the theoretically determined voltage value; and the actual grayscale voltage value or the adjusted grayscale voltage value being lower than the theoretically determined voltage value. The case in which the actual grayscale voltage value or the adjusted grayscale voltage value is not close to the theoretically determined voltage value may comprise: an absolute value of the difference between the actual grayscale voltage value or the adjusted grayscale voltage value and the theoretically determined voltage value is greater than or equal to a preset threshold, wherein a particular value of the preset threshold may be determined according to actual needs.

The source driver IC may output the actual grayscale voltage values of all the adjustable grayscales, or may output the actual grayscale voltage values of a part of the grayscales among all the adjustable grayscales.

In the present embodiment, the actual grayscale voltage value of the grayscale output from the source driver IC is compared with the corresponding theoretically determined voltage value of the grayscale, and when the actual grayscale voltage value deviates from the theoretically determined voltage value, the actual grayscale voltage value is adjusted one or more times, such that the adjusted final resulted grayscale voltage value equals or close to the theoretically determined voltage value, and the resulting adjusted grayscale voltage value is fed back to the source driver IC such that the source driver IC outputs a voltage according to the target voltage value, thereby resolving the problem in the related art that the actual grayscale voltage value output from the source driver IC is different from the theoretically determined voltage value.

The above adjusting circuit 101 may further comprise a notification sub circuit configured to notify the source driver IC to take the current actual grayscale voltage value of the grayscale as the target voltage value to be input to the display panel, when the comparison result indicates that the actual grayscale voltage is equal or close to the theoretically determined voltage value. That is, it is unnecessary to adjust the grayscale voltage.

The above adjusting circuit 101 may be implemented in a hardware circuit or a software stored in a machine-readable medium. For example, the adjusting circuit 101 may comprise a comparator configured to compare the actual grayscale voltage value of the grayscale with the theoretically determined voltage value of the grayscale to obtain a comparison result. An input terminal of the comparator is connected to the source driver IC and is configured to input the actual grayscale voltage value Vs_out. The theoretically determined voltage value Vref is input to another input terminal, and the comparison result Cout is output from an output terminal. The comparison result Cout may be represented in various forms. For example, when the comparison result Cout indicates that the actual grayscale voltage value Vs_out equals or close to the theoretically determined voltage value Vref, the comparator outputs "0", otherwise, the comparator outputs "1". Alternatively, when the comparison result Cout indicates that the actual grayscale voltage value Vs_out equals or close to the theoretically determined voltage value Vref, the comparator outputs "00"; when the comparison result Cout indicates that the actual grayscale voltage value Vs_out is higher than and not close to the theoretically determined voltage value Vref, the comparator outputs "01"; and when the comparison result Cout indicates that the actual grayscale voltage value Vs_out is lower than and not close to the theoretically determined voltage value Vref, the comparator outputs "10".

The above adjusting circuit 101 may further comprise:

a first adjusting sub circuit, configured to reduce the actual grayscale voltage value by a first adjusting step in the case where the comparison result indicates that the actual grayscale voltage value is higher than and not close to the theoretically determined voltage value, to obtain the adjusted grayscale voltage value; and a second adjusting sub circuit, configured to increase the actual grayscale voltage value by a second adjusting step in the case where the comparison result indicates that the actual grayscale voltage value is lower than and not close to the theoretically determined voltage value, to obtain the adjusted grayscale voltage value.

Optionally, the first adjusting step equals to the second adjusting step. Particular values of the first adjusting step and the second adjusting step may be determined according to the needs, for example, may be 1 mV (millivolt).

The above verification circuit may verify whether the adjusted grayscale voltage value is equal or close to the theoretically determined voltage value by various schemes, which will be described in detail hereinafter.

In an optional embodiment of the present disclosure, the verification circuit 102 may comprise:

a storage sub circuit, configured to store the comparison result obtained by each comparison of the adjusting circuit; and a comparing sub circuit, configured to compare a current comparison result with a previous comparison result, to determine that the adjusted grayscale voltage value is equal or close to the theoretically determined voltage value in the case where the current comparison result is different from the previous comparison result, and to determine that the adjusted grayscale voltage value is not equal or close to the theoretically determined voltage value in the case where the current comparison result is the same as the previous comparison result. It should be noted that only in the case where the previous comparison result indicates that the adjusted grayscale voltage value is not equal or close to the theoretically determined voltage value, a new comparison result, i.e., the current comparison result, will be generated. Further, a change rate of each adjustment of the grayscale voltage value is not excessively large. For example, if a previous grayscale voltage value is higher than and not close to the theoretically determined voltage value, after undergoing the adjustment once, the current grayscale voltage value may be still higher than and not close to the theoretically determined voltage value, or may be equal or close to the theoretically determined voltage value, but will not become lower than or not close to the theoretically determined voltage value.

The store sub circuit may be a register. Optionally, in order to save storage space, only one comparison result is stored, and the currently stored comparison result is overwritten when the next comparison result is input.

The comparing sub circuit may be implemented in various forms. For example, the comparing sub circuit may be a comparator or an XOR operator. When the comparing sub circuit is the XOR operator, an XOR operation may be performed on the current comparison result and the previous comparison result, and when the current comparison result is the same as the previous comparison result, e.g., when both the current comparison result and the previous comparison result indicate that the actual grayscale voltage value is higher than and not close to the theoretically determined voltage value, as described above, both the comparison results are represented by "01", which may indicate that the adjusted grayscale voltage value is still not equal or close to the theoretically determined voltage value, the XOR operator may output a result indicating that the adjusted grayscale voltage value is not equal or close to the theoretically determined voltage value, e.g., the output result may be "0". When the current comparison result is different from the previous comparison result, e.g., when the previous comparison result indicate that the actual grayscale voltage value is higher than and not close to the theoretically determined voltage value, while the current comparison result indicate that the actual grayscale voltage value is equal or close to the theoretically determined voltage value, which may indicate that the adjusted grayscale voltage value does not deviate from the theoretically determined voltage value, the XOR operator may output a result indicating that the adjusted grayscale voltage value is equal or close to the theoretically determined voltage value, e.g., the output result may be "1".

When the verification circuit 102 verifies that the adjusted grayscale voltage value is equal or close to the theoretically determined voltage value, the adjusted grayscale voltage value is required to be fed back to the source driver IC as the target voltage value to be input to the display panel of the display device. In particular, various methods may be used to feedback the adjusted grayscale voltage value to the source driver IC. For example, when the target voltage values of a part of the grayscales (comprising one or more grayscales) are received, the verification circuit 102 may feedback the target voltage values of these grayscales to the source driver IC. Alternatively, when the target voltage values of all adjustable grayscales of the source driver IC are received, the verification circuit 102 may feedback the target voltage values of all adjustable grayscales together to the source driver IC.

The source driver IC may update the actual grayscale voltage value of the output grayscale immoderately when receiving the target voltage value of each received grayscale. The source driver IC may also update the target voltage values of all adjustable grayscales together when receiving the target voltage values of all adjustable grayscales.

In order to control the start and end of the calibration, optionally, the grayscale voltage calibration device further comprises:

a second switch S2 disposed between the source driver IC and the adjusting circuit, wherein the second switch S2 is configured to be turned on to connect the source driver IC with the adjusting circuit when a calibration instruction is received, and be turned off to disconnect the source driver IC from the adjusting circuit when a calibration finish instruction is received.

Optionally, the grayscale voltage calibration device further comprises:

a first switch S1 disposed between the source driver IC and the display panel, wherein the first switch S1 is configured to be turned on to connect the source driver IC with the display panel when the calibration finish instruction is received.

Optionally, the verification circuit is connected to the first switch S1 and the second switch S2, and is configured to generate the calibration finish instruction when it is verified that the adjusted grayscale voltage value is equal or close to the theoretically determined voltage value.

The grayscale voltage calibration device may calibrate the grayscale voltage of the source driver IC either during an initialization period of the display device (i.e., during the start of the display device), or during a normal display period of the display device.

When the grayscale voltage is calibrated during the normal display period of the display device, the grayscale voltage output from the source driver IC may be directed along two paths, along one of which the grayscale voltage is provided to the display panel of the display device, and along the other the grayscale voltage is provided to the grayscale voltage calibration device. Accordingly, the normal display of the display panel will not be affected while calibrating the grayscale voltage.

In addition, the grayscale voltage calibration device may further comprise: a sampling circuit, configured to extract the actual grayscale voltage value of one or more grayscales from the grayscale voltage output from the source driver IC during the normal display period of the display device and transmit the actual grayscale voltage value to the adjusting circuit 101.

Figure 2:
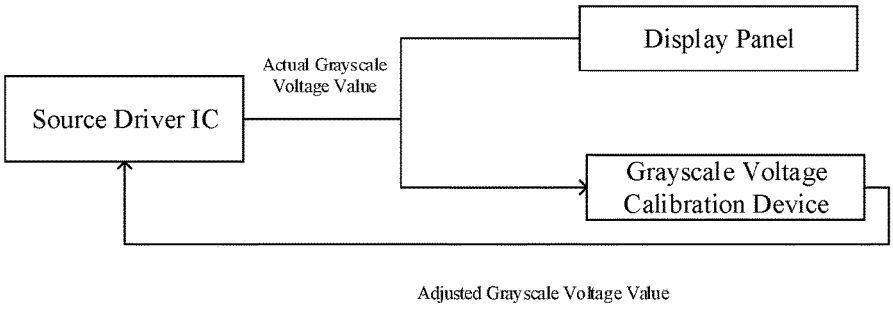
FIG. 2 is a schematic diagram illustrating a signal interaction of the grayscale voltage calibration device, a source driver IC and a display panel, while calibrating grayscale voltage during a normal display period of a display device using the grayscale voltage calibration device according to some embodiments of the present disclosure.

Referring to FIG. 2, when the grayscale voltage is calibrated during the normal display period of the display device, the grayscale voltage calibration device may feedback the adjusted voltage value to the source driver IC when receiving each adjusted grayscale voltage value, and the source driver IC may output a voltage to the display panel according to the adjusted grayscale voltage value immediately when receiving each adjusted grayscale voltage value fed back from the grayscale voltage calibration device.

Obviously, in some other embodiments of the present disclosure, the grayscale voltage calibration device may also feedback the adjusted grayscale voltage value to the source driver IC when receiving the target grayscale voltage value of the grayscale, and the source driver IC output the voltage to the display panel according to the received target grayscale voltage value.

Figure 3:
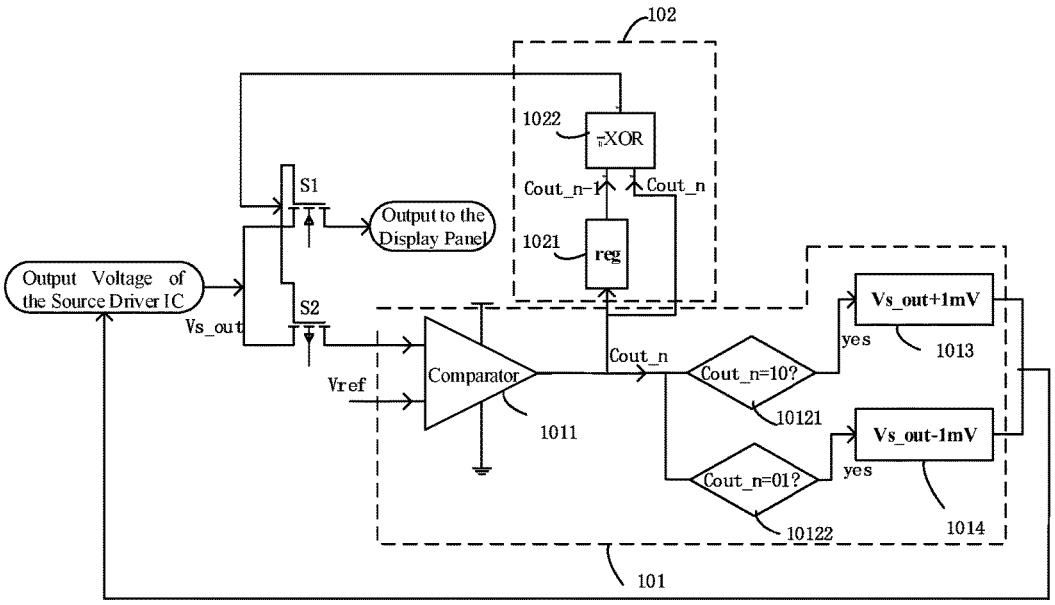
FIG. 3 is a structural schematic diagram of a grayscale voltage calibration device according to some embodiments of the present disclosure.

FIG. 3 is a structural schematic diagram of a grayscale voltage calibration device according to some embodiments of the present disclosure. Referring to FIG. 3, the grayscale voltage calibration device comprises a first switch S1, a second switch S2, an adjusting circuit 101, and a verification circuit 102.

In the present embodiment, the first switch S1 is an NMOS switch, and the second switch S2 is a PMOS switch. Obviously, in other embodiments of the present disclosure, the first switch S1 and the second switch S2 may be replaced with other logic switches such as transmission gate or the like.

When it is required to perform grayscale voltage calibration, the second switch S2 is turned on and the actual grayscale voltage value Vs_out output from the source driver IC will be input to the adjusting circuit 101 via the second switch S2.

The adjusting circuit 101 comprises a comparator 1011. An input terminal of the comparator 1011 is connected to the source driver IC via the second switch S2 to receive the actual grayscale voltage value Vs_out of the grayscale output from the source driver IC. The other input terminal of the comparator 1011 receives the theoretically determined voltage value Vref corresponding to the grayscale. An output terminal of the comparator 1011 outputs the comparison result Cout_n. In the present embodiment, when the comparison result indicates that the actual grayscale voltage value Vs_out is lower than and not close to the theoretically determined voltage value Vref, the comparison result Cout_n is "10"; when the comparison result indicates that the actual grayscale voltage value Vs_out is higher than and not close to the theoretically determined voltage value Vref, the comparison result Cout_n is "01"; and when the comparison result indicates that the actual grayscale voltage value Vs_out is equal or close to the theoretically determined voltage value Vref, the comparison result Cout_n is "00".

The adjusting circuit 101 further comprises a first judging sub circuit 10121, a second judging sub circuit 10122, a first adjusting sub circuit 1013, and a second adjusting sub circuit 1014. The first judging sub circuit 10121 is connected to the output terminal of the comparator 1011 and is configured to receive the comparison result output from the comparator 1011 and judge whether the comparison result Cout_n has a value equals to "10". If yes, the first adjusting sub circuit 1013 may increase the actual grayscale voltage value Vs_out by 1 mV to obtain the adjusted grayscale voltage value and feedback the adjusted grayscale voltage value to the source driver IC. The second judging sub circuit 10122 is connected to the output terminal of the comparator 1011 and is configured to receive the comparison result output from the comparator 1011 and judge whether the comparison result Cout_n has a value equals to "01". If yes, the second adjusting sub circuit 1014 may reduce the actual grayscale voltage value Vs_out by 1 mV to obtain the adjusted grayscale voltage value and feedback the adjusted grayscale voltage value to the source driver IC.

While the adjusting circuit 101 is adjusting the actual grayscale voltage value Vs_out, the verification circuit 102 judges whether the adjusted grayscale voltage has been equal or close to the theoretically determined voltage value Vref. In particular, the verification circuit 102 comprises a storage sub circuit (reg) 1021 and an XOR operator 1022. The storage sub circuit 1021 is connected to the output terminal of the comparator 1011 and is configured to receive and store the comparison result output from the comparator 1011. An input terminal of the XOR operator 1022 is connected to the output terminal of the comparator 1011 and receives the current comparison result Cout_n, and the other input terminal of the XOR operator 1022 is connected to the storage sub circuit 1021 and receives the previous comparison result Cout_(n−1). The XOR operator 1022 is configured to perform an XOR operation on the current comparison result Cout_n and the previous comparison result Cout_(n−1), and if the current comparison result Cout_n is the same as the previous comparison result Cout_(n−1), which indicates that the adjusted grayscale voltage value is not equal or not close to the theoretically determined voltage value, the XOR operator outputs "0". If the current comparison result Cout_n is different from the previous comparison result Cout_(n−1), which indicates that the adjusted grayscale voltage value is equal or close to the theoretically determined voltage value, the XOR operator outputs "1". It should be noted that, only in the case where the previous comparison result indicates that the adjusted grayscale voltage value is not equal or close to the theoretically determined voltage value, a new comparison result, i.e., the current comparison result, will be generated. Further, a change rate of each adjustment of the grayscale voltage value is not excessively large. For example, if a previous grayscale voltage value is higher than and not close to the theoretically determined voltage value, the Vs_out is reduced by 1 mV, and the current grayscale voltage value may be still higher than and not close to the theoretically determined voltage value, or may be equal or close to the theoretically determined voltage value, but will not become lower than or not close to the theoretically determined voltage value.

A gate electrode of the first switch S1 is connected to the output terminal of the XOR operator 1022. A source electrode thereof is connected to the source driver IC. A drain electrode thereof is connected to the display panel. A gate electrode of the second switch S2 is connected to the output terminal of the XOR operator 1022. A source electrode thereof is connected to the source driver IC. A drain electrode thereof is connected to the comparator 1011. When the second switch S2 receives a "0" output from the XOR operator, it maintains turned on, and the grayscale voltage calibration device continues to calibrate the actual grayscale voltage value output from the source driver IC. The second switch S2 is turned off when receiving "1" output from the XOR operator and the first switch S1 is turned on when receiving "1" output from the XOR operator, accordingly, the grayscale voltage calibration device stops calibrating the actual grayscale voltage value output from the source driver IC and the currently obtained adjusted grayscale voltage value is input to the display panel as the target grayscale voltage.

At this point, a grayscale voltage calibration process of one grayscale has been completed. The grayscale voltages of other grayscales of the source driver IC may be calibrated using the same method.

The grayscale voltage calibration device provided by the present disclosure is implemented using a simple circuit element, and has simple structure and low cost. Accordingly, the actual grayscale voltage value output from the source driver IC may progressively approach the theoretically determined voltage value.

Embodiments of the present disclosure further provide a system for calibrating grayscale voltage comprising at least one driver IC and the grayscale voltage calibration device according to any one of the above embodiments.

Figure 4:
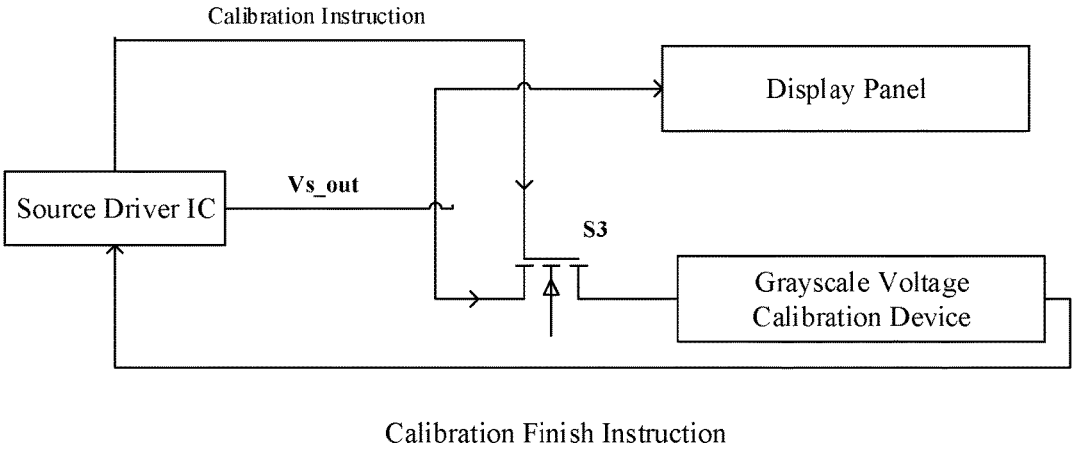
FIG. 4 is a schematic diagram illustrating a connection relation of the grayscale voltage calibration device, the source driver IC and the display panel according to some embodiments of the present disclosure.

Referring to FIG. 4, in the embodiment of the present disclosure, the grayscale voltage output from the source driver IC may be directed along two paths, along one of which the grayscale voltage is provided to the display panel of the display device, and along the other the grayscale voltage is provided to the grayscale voltage calibration device. Accordingly, the normal display of the display panel will not be affected while calibrating the grayscale voltage.

In order to control the start and end of the calibration, referring to FIG. 4, the grayscale voltage calibration device according to the embodiment of the present disclosure may further comprise:

a third switch S3 disposed between the source driver IC and the grayscale voltage calibration device, wherein the third switch S3 is configured to be turned on to connect the source driver IC with the grayscale voltage calibration device when a calibration instruction is received, and to be turned off to disconnect the source driver IC from the grayscale voltage calibration device when a calibration finish instruction is received.

In the above embodiment, the grayscale voltage calibration device may feedback the adjusted voltage value to the source driver IC when receiving each adjusted grayscale voltage value. Alternatively, the grayscale voltage calibration device may feedback the target voltage values of the received part of grayscales to the source driver IC when receiving the target voltage values of a part of grayscales (comprising one or more grayscales) among all the grayscales of the source driver IC. Alternatively, the grayscale voltage calibration device may feedback the target voltage values of all the grayscales together to the source driver IC when receiving the target voltage values of all the grayscales of the source driver IC.

The source driver IC may output a voltage to the display panel according to the received adjusted grayscale voltage value when receiving each adjusted grayscale voltage value fed back from the grayscale voltage calibration device. Alternatively, the source driver IC may output a voltage to the display panel according to the target voltage values of the part of grayscales when receiving the target voltage values of a part of grayscales among all the grayscales of the source driver IC. Alternatively, the source driver IC may output a voltage to the display panel according to the target voltage values of all the grayscales when receiving the target voltage values of all the grayscales of the source driver IC.

Currently, a middle or large sized display panel generally comprises a plurality of source driver ICs due to the limited driving capability of the source driver IC. However, the source driver ICs may have different driving capabilities due to the minor differences for example in processing conditions. These minor differences may cause significant differences in grayscale voltages in different regions under a severe environment such as high temperature, low temperature, unstable power supply, or the like, resulting in unevenness in the displayed image of the display panel.

The system for calibrating grayscale voltage according to some embodiments of the present disclosure may comprise a plurality of source driver ICs and at least one grayscale voltage calibration device. The grayscale voltage calibration device is configured to perform grayscale voltage calibration on the plurality of source driver ICs, such that the actual grayscale voltage value output from each source driver IC is equal or close to the theoretically determined voltage value, thereby avoiding significant differences in grayscale voltages provided to different regions of the display panel, such that the image displayed on the display panel may be uniform.

Figure 5:
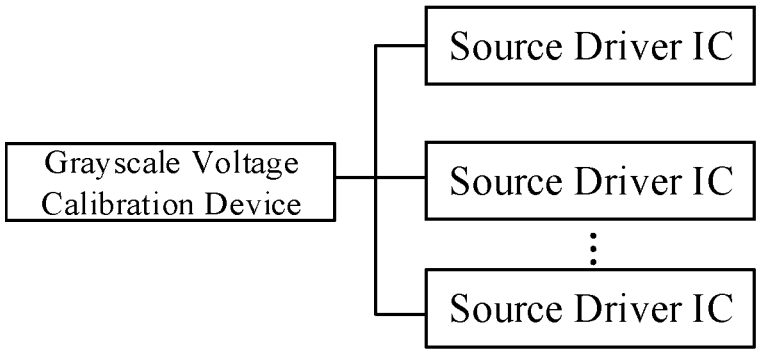
FIG. 5 is a structural schematic diagram of a grayscale voltage calibration device according to some embodiments of the present disclosure.

Referring to FIG. 5, in some embodiments of the present disclosure, the system comprises one grayscale voltage calibration device and a plurality of source driver ICs. The grayscale voltage calibration device is connected to the plurality of source driver ICs, and is configured to adjust the actual grayscale voltage values of the grayscales in the plurality of source driver ICs. In particular, the grayscale voltage calibration device may successively calibrate the grayscale voltage values in the plurality of source driver ICs. Alternatively, the grayscale voltage calibration device may calibrate the grayscale voltage values in some source driver ICs among the plurality of source driver ICs. According to such a configuration, it is possible to reduce the number of the grayscale voltage calibration devices and reduce cost.

Figure 6:
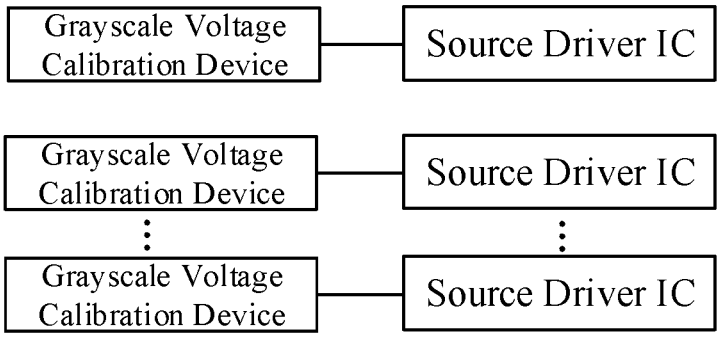
FIG. 6 is a structural schematic diagram of a grayscale voltage calibration device according to some embodiments of the present disclosure.
Figure 7:
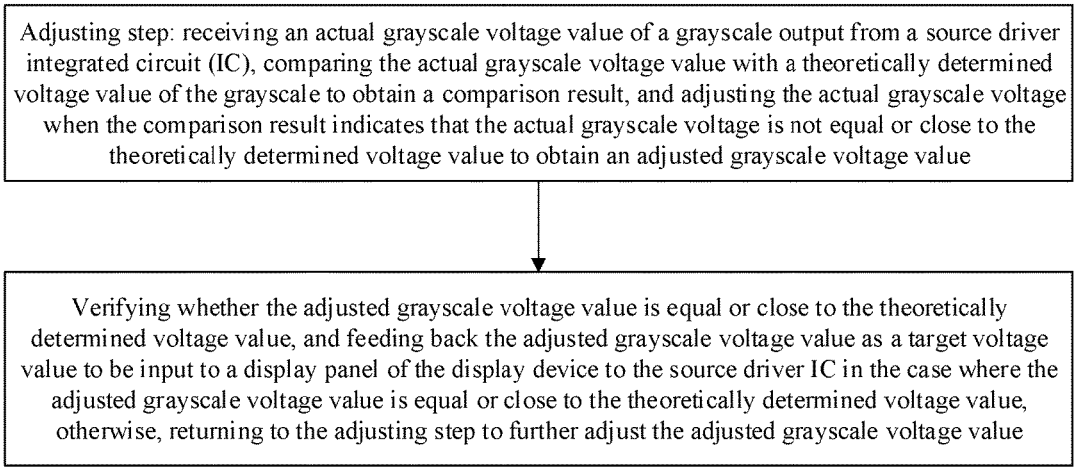
FIG. 7 is a flow chart of a method for calibrating grayscale voltage according to some embodiments of the present disclosure.

Referring to FIG. 6, in another embodiment of the present disclosure, the system comprises a plurality of grayscale voltage calibration devices and a plurality of source driver ICs. The plurality of grayscale voltage calibration devices are connected to the plurality of source driver ICs, respectively, and are configured to adjust the actual grayscale voltage values of the grayscales in the plurality of source driver ICs. According to such a configuration, it is possible to simultaneously calibrate the actual grayscale voltage values of the grayscales of a plurality of source driver ICs and reduce calibration time.

Embodiments of the present disclosure further provide a display device comprising the system for calibrating grayscale voltage according to any one of the above embodiments.

Embodiments of the present disclosure further provide a method for calibrating grayscale voltage, comprising:

an adjusting step: receiving an actual grayscale voltage value of a grayscale output from a source driver integrated circuit (IC), comparing the actual grayscale voltage value with a theoretically determined voltage value of the grayscale to obtain a comparison result, and adjusting the actual grayscale voltage when the comparison result indicates that the actual grayscale voltage is not equal or close to the theoretically determined voltage value to obtain an adjusted grayscale voltage value; and a verification step: verifying whether the adjusted grayscale voltage value is equal or close to the theoretically determined voltage value, and feeding back the adjusted grayscale voltage value as a target voltage value to be input to a display panel of the display device to the source driver IC in the case where the adjusted grayscale voltage value is equal or close to the theoretically determined voltage value, otherwise, returning to the adjusting step to further adjust the adjusted grayscale voltage value.

Optionally, the adjusting step further comprises:

notifying the source driver IC to take the current actual grayscale voltage value of the grayscale as the target voltage value to be input to the display panel, when the comparison result indicates that the actual grayscale voltage is equal or close to the theoretically determined voltage value.

Optionally, the adjusting step comprises:

reducing the actual grayscale voltage value by a first adjusting step (i.e., a magnitude of the voltage value adjusted once, also referred to as a first adjusting pitch) in the case where the comparison result indicates that the actual grayscale voltage value is higher than and not close to the theoretically determined voltage value, to obtain the adjusted grayscale voltage value; and increasing the actual grayscale voltage value by a second adjusting step (i.e., a magnitude of the voltage value adjusted once, also referred to as a second adjusting pitch) in the case where the comparison result indicates that the actual grayscale voltage value is lower than and not close to the theoretically determined voltage value, to obtain the adjusted grayscale voltage value.

Optionally, the first adjusting step equals to the second adjusting step.

Optionally, the verification step comprises:

storing each comparison result; and comparing a current comparison result with a previous comparison result, determining that the adjusted grayscale voltage value is equal or close to the theoretically determined voltage value in the case where the current comparison result is different from the previous comparison result, and determining that the adjusted grayscale voltage value is not equal or not close to the theoretically determined voltage value in the case where the current comparison result is the same as the previous comparison result.

It should be noted that only in the case where the previous comparison result indicates that the adjusted grayscale voltage value is not equal or close to the theoretically determined voltage value, a new comparison result, i.e., the current comparison result, will be generated. Further, a change rate of each adjustment of the grayscale voltage value is not excessively large. For example, if a previous grayscale voltage value is higher than and not close to the theoretically determined voltage value, after undergoing the adjustment once, the current grayscale voltage value may be still higher than and not close to the theoretically determined voltage value, or may be equal or close to the theoretically determined voltage value, but will not become lower than or not close to the theoretically determined voltage value.

Optionally, prior to the comparing, the method for calibrating grayscale voltage further comprises:

extracting actual grayscale voltage value of one or more grayscales from grayscale voltages output from the source driver IC, during a normal display period of the display device.

The foregoing are preferred embodiments of the present disclosure, and it should be noted that various improvements and modifications are possible to those ordinary skilled in the art without departing from the principle of the present disclosure. All these improvements and modifications will also fall into the protection scope of the present disclosure.

What is claimed is:

1. A grayscale voltage calibration device applicable in a display device, comprising:

an adjusting circuit, configured to receive an actual grayscale voltage value of a grayscale output from a source driver integrated circuit (IC), to compare the actual grayscale voltage value with a theoretically determined voltage value of the grayscale to obtain a comparison result, and to adjust the actual grayscale voltage when the comparison result indicates that the actual grayscale voltage is not equal or close to the theoretically determined voltage value to obtain an adjusted grayscale voltage value; and a verification circuit, connected to the adjusting circuit, and configured to verify whether the adjusted grayscale voltage value is equal or close to the theoretically determined voltage value, and to feedback the adjusted grayscale voltage value as a target voltage value to be input to a display panel of the display device to the source driver IC in the case where the adjusted grayscale voltage value is equal or close to the theoretically determined voltage value, otherwise, to control the adjusting circuit to further adjust the adjusted grayscale voltage value.

2. The grayscale voltage calibration device according to claim 1, wherein the adjusting circuit comprises:

a notification sub circuit, configured to notify the source driver IC to take the current actual grayscale voltage value of the grayscale as the target voltage value to be input to the display panel, when the comparison result indicates that the actual grayscale voltage is equal or close to the theoretically determined voltage value.

3. The grayscale voltage calibration device according to claim 1, wherein the adjusting circuit comprises a comparator, the actual grayscale voltage value is input to an input terminal of the comparator, the theoretically determined voltage value is input to another input terminal of the comparator, and the comparison result is output from an output terminal of the comparator.

4. The grayscale voltage calibration device according to claim 1, wherein the adjusting circuit comprises:

a first adjusting sub circuit, configured to reduce the actual grayscale voltage value by a first adjusting step in the case where the comparison result indicates that the actual grayscale voltage value is higher than and not close to the theoretically determined voltage value, to obtain the adjusted grayscale voltage value; and a second adjusting sub circuit, configured to increase the actual grayscale voltage value by a second adjusting step in the case where the comparison result indicates that the actual grayscale voltage value is lower than and not close to the theoretically determined voltage value, to obtain the adjusted grayscale voltage value.

5. The grayscale voltage calibration device according to claim 1, wherein the verification circuit comprises:

a storage sub circuit, configured to store the comparison result obtained by each comparison of the adjusting circuit; and a comparing sub circuit, configured to compare a current comparison result with a previous comparison result, to determine that the adjusted grayscale voltage value is equal or close to the theoretically determined voltage value in the case where the current comparison result is different from the previous comparison result, and to determine that the adjusted grayscale voltage value is not equal or close to the theoretically determined voltage value in the case where the current comparison result is the same as the previous comparison result.

6. The grayscale voltage calibration device according to claim 1 further comprising:

a second switch disposed between the source driver IC and the adjusting circuit, wherein the second switch is configured to be turned on to connect the source driver IC with the adjusting circuit when a calibration instruction is received, and to be turned off to disconnect the source driver IC from the adjusting circuit when a calibration finish instruction is received.

7. The grayscale voltage calibration device according to claim 6 further comprising:

a first switch disposed between the source driver IC and the display panel, wherein the first switch is configured to be turned on to connect the source driver IC with the display panel when the calibration finish instruction is received.

8. The grayscale voltage calibration device according to claim 7, wherein the verification circuit is connected to the first switch and the second switch, and is configured to generate the calibration finish instruction when it is verified that the adjusted grayscale voltage value is equal or close to the theoretically determined voltage value.

9. The grayscale voltage calibration device according to claim 1, further comprising:

a sampling circuit, configured to extract actual grayscale voltage value of one or more grayscales from the grayscale voltages output from the source driver IC and to transmit the actual grayscale voltage value to the adjusting circuit, when the grayscale voltage is calibrated during a normal display period of the display device.

10. A system for calibrating grayscale voltage, comprising at least one source driver integrated circuit (IC) and at least one grayscale voltage calibration device according to claim 1.

11. The system for calibrating grayscale voltage according to claim 10, wherein the grayscale voltage calibration device is configured to:

when receiving each adjusted grayscale voltage value, feedback the adjusted grayscale voltage value to the source driver IC; or when receiving the target voltage values of a part of grayscales among all the grayscales of the source driver IC, feedback the received target voltage values of the part of grayscales to the source driver IC; or when receiving the target voltage values of all the grayscales of the source driver IC, feedback the target voltage values of all the grayscales together to the source driver IC.

12. The system for calibrating grayscale voltage according to claim 10, wherein the source driver IC is configured to:

when receiving each adjusted grayscale voltage value fed back from the grayscale voltage calibration device, output a voltage to the display panel according to the adjusted grayscale voltage value; or when receiving the target voltage values of a part of grayscales among all the grayscales of the source driver IC, output a voltage to the display panel according to the target voltage values of the part of grayscales; or when receiving the target voltage values of all the grayscales of the source driver IC, output a voltage to the display panel according to the target voltage values of all the grayscales.

13. The system for calibrating grayscale voltage according to claim 10, wherein the system comprises one grayscale voltage calibration device and a plurality of source driver ICs, the grayscale voltage calibration device is connected to the plurality of source driver ICs, and is configured to adjust the actual grayscale voltage values of the grayscales in the plurality of source driver ICs.

14. The system for calibrating grayscale voltage according to claim 10, wherein the system comprises a plurality of grayscale voltage calibration devices and a plurality of source driver ICs, the grayscale voltage calibration devices are connected to the plurality of source driver ICs one by one, and are configured to adjust the actual grayscale voltage values of the grayscales in the plurality of source driver ICs.

15. A display device, comprising the system for calibrating grayscale voltage according to claim 10.

16. A method for calibrating grayscale voltage applicable in a display device, comprising:

an adjusting step: receiving an actual grayscale voltage value of a grayscale output from a source driver integrated circuit (IC), comparing the actual grayscale voltage value with a theoretically determined voltage value of the grayscale to obtain a comparison result, and adjusting the actual grayscale voltage when the comparison result indicates that the actual grayscale voltage is not equal or close to the theoretically determined voltage value to obtain an adjusted grayscale voltage value; and a verification step: verifying whether the adjusted grayscale voltage value is equal or close to the theoretically determined voltage value, and feeding back the adjusted grayscale voltage value as a target voltage value to be input to a display panel of the display device to the source driver IC in the case where the adjusted grayscale voltage value is equal or close to the theoretically determined voltage value, otherwise, returning to the adjusting step to further adjust the adjusted grayscale voltage value.

17. The method for calibrating grayscale voltage according to claim 16, wherein the adjusting step further comprises:

notifying the source driver IC to take the current actual grayscale voltage value of the grayscale as the target voltage value to be input to the display panel, when the comparison result indicates that the actual grayscale voltage is equal or close to the theoretically determined voltage value.

18. The method for calibrating grayscale voltage according to claim 16, wherein the adjusting step further comprises:

reducing the actual grayscale voltage value by a first adjusting step in the case where the comparison result indicates that the actual grayscale voltage value is higher than and not close to the theoretically determined voltage value, to obtain the adjusted grayscale voltage value; and increasing the actual grayscale voltage value by a second adjusting step in the case where the comparison result indicates that the actual grayscale voltage value is lower than and not close to the theoretically determined voltage value, to obtain the adjusted grayscale voltage value.

19. The method for calibrating grayscale voltage according to claim 16, wherein the verification step comprises:

storing each comparison result; and comparing a current comparison result with a previous comparison result, determining that the adjusted grayscale voltage value is equal or close to the theoretically determined voltage value in the case where the current comparison result is different from the previous comparison result, and determining that the adjusted grayscale voltage value is not equal or close to the theoretically determined voltage value in the case where the current comparison result is the same as the previous comparison result.

20. The method for calibrating grayscale voltage according to claim 16, wherein prior to the comparing, the method for calibrating grayscale voltage further comprises:

extracting the actual grayscale voltage value of one or more grayscales from the grayscale voltage output from the source driver IC, during a normal display period of the display device.

* * * * *